US006481748B1

(12) United States Patent
Okuda et al.

(10) Patent No.: US 6,481,748 B1
(45) Date of Patent: Nov. 19, 2002

(54) COUNTERWEIGHT FOR CONSTRUCTION VEHICLE

(75) Inventors: Kozo Okuda, Hirakata (JP); Yoshitsugu Shigehisa, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/606,234

(22) Filed: Jun. 28, 2000

(30) Foreign Application Priority Data

Jul. 30, 1999 (JP) ..... 11-217882
Nov. 24, 1999 (JP) ..... 11-332695

(51) Int. Cl.[7] ..... B60R 21/00
(52) U.S. Cl. ..... 280/755; 280/759
(58) Field of Search ..... 280/755, 757, 280/759

(56) References Cited

FOREIGN PATENT DOCUMENTS

| | | |
|---|---|---|
| JP | 61-17334 | 1/1986 |
| JP | 4-30151 | 3/1992 |
| JP | 4-30152 | 3/1992 |
| JP | 6-34438 | 9/1994 |
| JP | 2548492 | 5/1997 |
| JP | 11-181834 | 7/1999 |

*Primary Examiner*—Eric Culbreth
(74) *Attorney, Agent, or Firm*—Armstrong, Westerman & Hattori, LLP.

(57) ABSTRACT

An object is to provide an arrangement which enables the worker to easily carry out checking and maintenance on a part such as an engine from outside in a natural pose without climbing on a counterweight. In a construction vehicle having a traveling vehicle body and a revolving superstructure with an implement, a counterweight installed in the rear of the revolving superstructure comprises a detachable, separable sub-counterweight which is located on the position corresponding to the position of a part requiring maintenance.

6 Claims, 10 Drawing Sheets

COUNTERWEIGHT FOR CONSTRUCTION VEHICLE

TECHNICAL FIELD

The present invention relates to a counterweight for use in a construction vehicle such as a hydraulic shovel and crane in which an implement is mounted on the front part of a revolving superstructure.

BACKGROUND ART

In a known construction machine such as a hydraulic shovel and movable crane, a counterweight is placed in the rear of a revolving superstructure to maintain a balance relative to the weight of load on the implement which is mounted on the front part of the revolving superstructure. Such a counterweight is indispensable but obstructive since it occupies much installation space, and therefore, there have been proposed many ideas for making use of the space of a counterweight.

With structural reductions in the space of the rear part of the machine body, several techniques have been proposed for giving various functions to parts of a counterweight in order to facilitate checking and maintenance of the peripheral devices of the engine. One example is disclosed in Japanese Utility Model Publication (KOKAI) No. 4-30151 (1992) which has a notch recess formed on the center portion of a counterweight for facilitating checking and maintenance of engine parts and a lid plate for covering the notch recess. When doing a check and maintenance, the lid plate is raised so that the worker can easily carry out work, utilizing the recess. Another example is disclosed in Japanese Utility Model Publication (KOKAI) No. 4-30152 (1992). According to this publication, the inner portion of the center of a counterweight is partially cut away to form a recess in which an auxiliary counterweight is embedded. This auxiliary counterweight is provided with a vent hole for interconnecting the inside and outside of the machine body thereby exhausting air from the engine to the outside of the machine through the vent hole.

Japanese Utility Model Publication (KOKAI) No. 61-17334 (1986) discloses a counterweight that can be split into front and rear portions. This counterweight is provided with a ventilation opening located at a position opposite to the engine and an exhaust silencer is put into the ventilation opening to reduce the exhaust noise of the engine.

Japanese Utility Model No. 2548492 discloses a counterweight part of which is provided with an exhaust duct thereby increasing the engine cooling effect as well as the noise eliminating effect.

Another example is proposed by Japanese Utility Model Publication (KOKOKU) No. 6-34438 (1994) according to which, a counterweight is divided into a center block and right and left blocks. In this counterweight, either the peripheral edge of the side face of the center block or the peripheral edge of the side face of the side block opposite to the peripheral edge of the center block is allowed to project and the other is recessed, such that the outer surfaces of the center and side blocks are connected to each other in a continuous fashion without a gap.

As described above, there have been already proposed various ideas for counterweights which are used in a construction vehicle composed of a lower traveling system and a revolving superstructure with an implement and are placed in the rear of the revolving superstructure. On the other hand, middle-sized and small-sized construction machines are recently widely used and the counterweights for such machines have to be placed near the center of rotation since these construction machines are required to make a small sharp turn and therefore have a small radius of turn. This reduces the installation space for the engine and its accessories mounted in the rear of the revolving superstructure, causing many troubles.

One of the above troubles is that since the counterweight is installed in the rear of the revolving superstructure so as to enclose the engine, leaving insufficient space, the workability of checking and maintenance of the engine, radiator and control valves such as the main pump becomes extremely poor. Therefore, the whole counterweight needs to be removed for carrying out checking and repair work (maintenance), so that much time is required when checking and repairing troubled parts in other locations (e.g., job sites) than repair shops.

The prior art arrangements described earlier are mostly associated with the construction machines having sufficient installation space for the counterweight. However, the above-described problem is outstanding in the case of middle-sized and small-sized machines of small-turn type which are required to install a counterweight in the proximity of the engine installing section.

In addition, for mounting a split counterweight in the rear of the revolving superstructure, its assembly structure must be simplified to facilitate assembly operation. However, the above-described prior art techniques do not pay much attention to the simplicity and safety of disassembly and assembly operations but only take into consideration the ease of maintenance achieved by disassembling or elegant design.

The present invention is directed to overcoming the foregoing problems and a primary object of the invention is therefore to provide a counterweight for use in a construction vehicle which allows a worker to safely easily carry out, from outside, checking and maintenance on parts such as an engine, while being in a natural pose without climbing on the counterweight.

DISCLOSURE OF THE INVENTION

The above object can be achieved by a counterweight for use in a construction vehicle according to the invention, which is used in a construction vehicle having a traveling vehicle body and a revolving superstructure with an implement, and wherein a region of the counterweight corresponding to the position of a part requiring maintenance is detachably formed.

In the above arrangement, the invention provides a counterweight for a construction vehicle which is designed to be partially dividable such that a region necessary for checking and maintenance can be detached. By virtue of this, when a check and repairs (corrective maintenance) are required for the engine or a similar part which is placed on the revolving superstructure, being ahead of the counterweight, the region of the counterweight corresponding to the position of the part can be detached so that the troubled portion of the part can be directly accessed from outside for repairing. With this arrangement, the worker is no longer required to disassemble and assemble devices, climbing on the counterweight and taking an awkward pose in a confined space, and as a result, the worker can quickly carry out repair work from the ground.

In the invention, the counterweight installed in the rear of the revolving superstructure is preferably provided with an opening which transversely penetrates through the counterweight. With such an opening that transversely penetrates through the counterweight at the position corresponding to the position of the engine and other parts disposed on the revolving superstructure, the troubled portion of the parts can be directly accessed from outside by bringing the opening into its open state. This increases workability and allows quick access when carrying out repair work, for instance, at a job site.

Preferably, the opening transversely penetrating through the counterweight is located on the central upper part of the counterweight and a separable sub-counterweight can be mounted on this opening from above so as to be detachable therefrom. With this arrangement, when there arises a need for a check and repairs for the engine section, the side of the engine section can be largely exposed by detaching the separable sub-counterweight so that the engine can be easily dealt with from outside. If the opening is defined at such a position that the worker faces the engine section through the opening when standing on the ground, the worker can carry out a check and repairs on the engine section in the most convenient pose only by bringing the opening into its open state, which brings about improved working efficiency.

It is preferable that the right and left corners of the counterweight be respectively provided with such an opening and separable sub-counterweights be detachably mounted on the openings located at these corners. When making a check and repairs on parts disposed in front of the aforesaid right and left corners, the parts facing the openings can be easily repaired from outside through the openings by detaching the separable sub-counterweights, similarly to the case of the opening defined at the center.

In the invention, the counterweight installed in the rear of the revolving superstructure is preferably designed such that an auxiliary sub-counterweight is detachably disposed on the inner side of the upper half portion of the central sub-counterweight located at the center and such that either or both of the right and left of the counterweight are provided with a separable sub-counterweight detachably formed. In this arrangement, the central sub-counterweight, the auxiliary sub-counterweight and the separable sub-counterweights can be adjusted to have substantially the same weight so that these sub-counterweights can be attached and detached with the same equipment (e.g., hoisting crane), resulting in easy operation.

It is preferable that the parting faces of the central sub-counterweight and separable sub-counterweight be provided with an engagement section. When this arrangement is employed in a small-turn type construction machine in which sufficient installation space is not left for the counterweight after installation of the engine and other devices in the rear of the revolving superstructure so that there is a difficulty in checking and maintenance of the engine and other devices, checking and maintenance of a troubled device can be easily carried out without interference by detaching a sub-counterweight which is located at the position corresponding to the position of the devices requiring repairs. Especially, detachment of a separable sub-counterweight enables the worker to work from outside in a convenient condition to treat the engine section and pumps installed in a minimum space and to carry out the work on the ground, so that improved working efficiency can be achieved.

The engagement section is a fitting section formed on the central sub-counterweight and separable sub-counterweight. This fitting section preferably has a gap and serves as a stopper as well at the time of detachment. The fitting section preferably comprises a projection on the parting face of a sub-counterweight working as a base and an engagement recess defined in the parting face of a sub-counterweight which fits to the parting face of the base sub-counterweight. The engagement recess is designed to be fitted on the projection and the parting faces are fastened by fasteners from outside.

In this arrangement, the counterweight has the fitting structure and is fixedly fastened by fasteners at its parting section, so that a separable sub-counterweight which is heavy in weight can be easily positioned at the time of attachment or detachment, by virtue of the gap between the projection formed on the parting face of the sub-counterweight which works as a base and the recess formed on the sub-counterweight which mates with the base sub-counterweight (the positions of the projection and the recess may be reversed). In the case of a small-turn type implement which does not have sufficient installation space for a counterweight, even if the separable sub-counterweight to be detached is shifted, by the distance corresponding to the gap, from a predetermined position relative to the parts attached to the revolving superstructure, one of the faces constituting the fitting structure that is for instance the face opposite to the projection functions as a stopper, so that the collision between the separable sub-counterweight and the parts positioned inside the sub-counterweight can be avoided and security can be ensured.

The central sub-counterweight and separable sub-counterweight have, at their lower portions, a common lower face plate used for maintenance of lower parts. While the conventional counterweight has a mounting section which is formed by extending the rear part of the revolving frame in order to attach a detachable cover to a position under the part requiring repairs and in the proximity of the counterweight mounting section, such a mounting part can be omitted from the counterweight of the invention thanks to the above arrangement so that the underside of the counterweight can be utilized. As a result, a simple structure can be obtained and the revolving frame can be simplified, leading to a reduction in weight as well as improved economy.

BEST MODE FOR CARRYING OUT THE INVENTION

Referring to the accompanying drawings, preferred embodiments of the counterweight for a construction vehicle according to the invention will be hereinafter concretely described.

Figure 1:
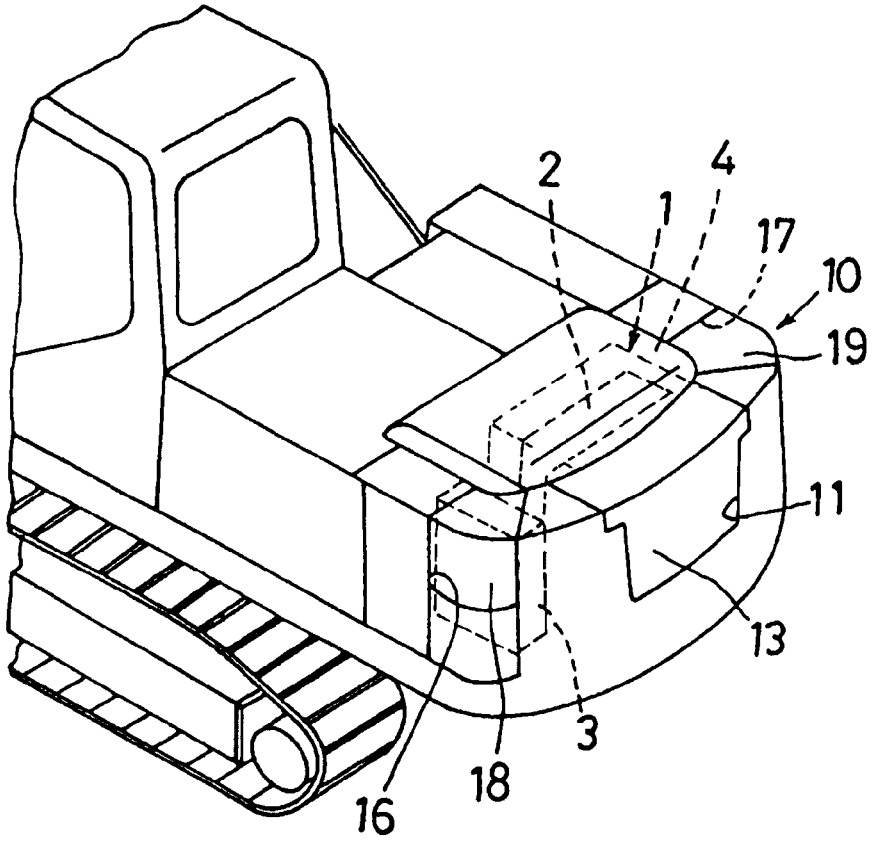
FIG. 1 is a perspective view showing the rear part of a construction vehicle having a counterweight constructed according to a first embodiment of the invention.
Figure 2:
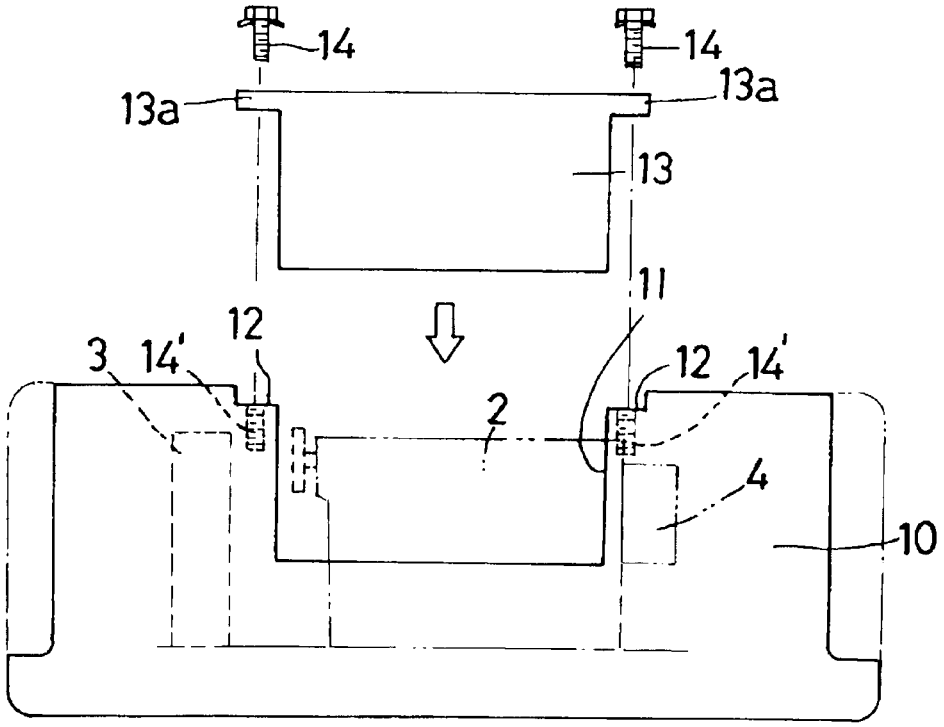
FIG. 2 is a front view of a counterweight installing section according to the first embodiment, which shows a separable sub-counterweight being separated.
Figure 3:
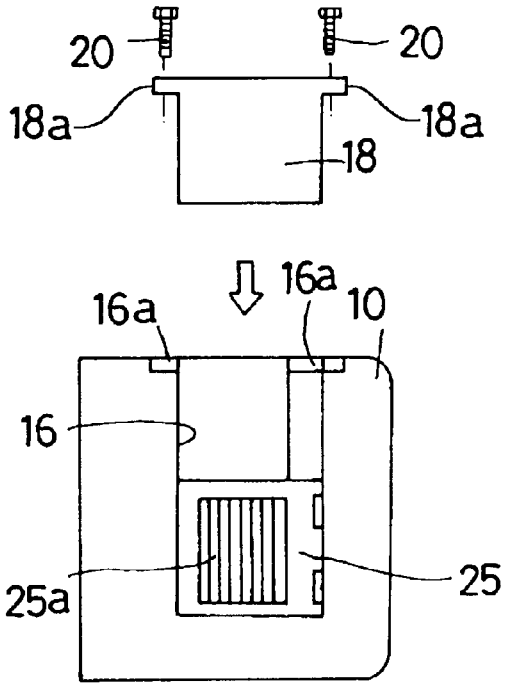
FIGS. 3(*a*) and 3(*b*) show the relationship between separable sub-counterweights according to the first embodiment disposed at the right and left corners and openings, FIG. 3(*a*) showing the left corner while FIG. 3(*b*) shows the right corner.
Figure 3:
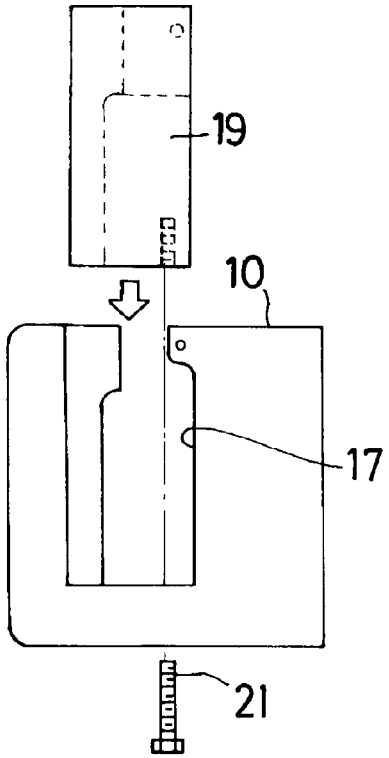

FIG. 1 is a perspective view showing the rear part of a construction vehicle having a counterweight constructed according to a first embodiment of the invention. FIG. 2 is a front view of a counterweight installing section according to the first embodiment, which shows a separable sub-counterweight in a separated condition. FIGS. 3(*a*) and 3(*b*) show the relationship between separable sub-counterweights disposed at the right and left corners and openings, FIG. 3(*a*) showing the left corner while FIG. 3(*b*) shows the right corner.

As seen from these figures, a counterweight 10 of the present embodiment is installed in the rear of an engine chamber 1 so as to enclose the engine chamber 1 which is mounted on the rear part of a revolving superstructure (not shown) of a construction machine such as a hydraulic shovel. Defined at the central upper part of the counterweight 10 is an opening 11 which penetrates through the counterweight 10, extending from the engine chamber 1 in a backward and outward direction and which opens at the top of the counterweight 10. A separable sub-counterweight 13 formed into such a shape that exactly fits to the opening 11 is fitted in the opening 11. The separable sub-counterweight 13 is designed to be detachable from the opening 11 when the engine 2 housed in the engine chamber 1 is checked and repaired.

Inside the right and left corners of the counterweight 10, a radiator 3 for cooling the engine and a main pump 4 for fuel supply are respectively disposed on the revolving superstructure. Openings 16, 17 are defined at the right and left corners of the counterweight 10 so as to correspond to the radiator 3 and the main pump 4, respectively. Separable sub-counterweights 18, 19 are detachably attached to these openings 16, 17.

The opening 11 defined at the center of the counterweight 10 has such a depth and width as to substantially expose the side face of the engine 2 that is installed in front of the counterweight 10 and on the revolving superstructure. Both side faces of the opening 11 are tapered upward so that the separable sub-counterweight 13 can be easily pulled up from and fitted in the opening 11. At both sides of the upper edge of the opening 11, there are provided stepped portions 12 respectively having desired widths. These stepped portions 12 serve as mountings for mounting flanges 13*a* which are formed so as to project from both sides of the upper part of the separable sub-counterweight 13 to be fitted in the opening 11. The mounting flanges 13*a* are respectively bolted to threaded holes 14' defined in the main body of the counterweight 10 by means of bolts 14.

Preferably, the outer side face and top face of the separable sub-counterweight 13 are substantially flush with the outer side face and top face of the counterweight 10 respectively, when the separable sub-counterweight 13 is fitted in and bolted to the opening 11, with its side faces being fitted to the tapered side faces of the opening 11. The separable sub-counterweight 13 is thus formed so that when it is combined with the main body of the counterweight 10, they provide a flush contour, without marring the appearance of the counterweight 10. The right and left side faces of the opening 11 may be sloped such that the spacing between them is slightly widened from the outside toward the inside. This arrangement allows the counterweight 10 to be kept in a stable condition without flying outward due to centrifugal force when the revolving superstructure rotates.

As shown in FIG. 3(*a*) and 3(*b*), the openings 16 and 17 defined at the right and left corners respectively have such a mounting structure that allows secure mounting of the separable sub-counterweights 18, 19 so that the separable sub-counterweights 18, 19 can be held in a stable fashion at the time of rotation by fastening with bolts 20, 21. The opening 16 at the left corner has, at its lower half portion, an openable cover 25 with a louver 25*a* in order to exhaust cooling air to the radiator, while the upper half portion is designed to accommodate the separable sub-counterweight 18. For mounting, the separable sub-counterweight 18 is provided with flanges 18*a* formed on both sides of the upper part thereof like the central separable sub-counterweight 13, and stepped portions 16*a* are formed on both edges of the upper end of the opening 16 of the counterweight 10 as mountings to which the separable sub-counterweight 18 can be fastened by means of bolts 20.

In the counterweight 10 of the first embodiment having the above-described structure, the sub-counterweights 13, 18, 19 are fitted in and bolted to the openings 11, 16, 17 respectively so that it functions similarly to the conventional counterweights and does not interfere with the operation of the implement (not shown).

When making a check and repairs (corrective maintenance) on the peripheral devices of the engine in situ or in a repair shop, the bolts 14 which fasten the central separable sub-counterweight 13 are removed and the separable sub-counterweight 13 is lifted by a hoisting machine thereby bringing the opening 11 defined in the upper half part of the counterweight 10 into its open state. In this condition, the engine 2 housed in the engine chamber 1 located inside is exposed so that the worker can check the engine while standing on the floor or ground. Hence, the worker can carry out, in a stable pose, maintenance work such as adjustment of a fuel injection pump, compressor and others and exchange of a fan belt.

By detaching the separable sub-counterweight 18 from the opening 16 at the left corner, the worker can carry out, in a natural pose, maintenance on the radiator 3 used for cooling. Similarly, by detaching the separable sub-counterweight 19 at the right corner from the opening 17, the worker can easily make a check and repairs on the parts (e.g., the control valve 4 for the main pump) disposed in a position facing the opening 17.

Previously, the worker had to climb on a counterweight to check and repair the engine, fuel supplying devices or cooling devices housed in the engine chamber. According to the first embodiment, the worker can carry out a maintenance (repairs) and checking work from the outside of the counterweight without climbing on it, which not only provides considerably improved workability but also makes it possible to easily carry out a reliable work.

Figure 4:
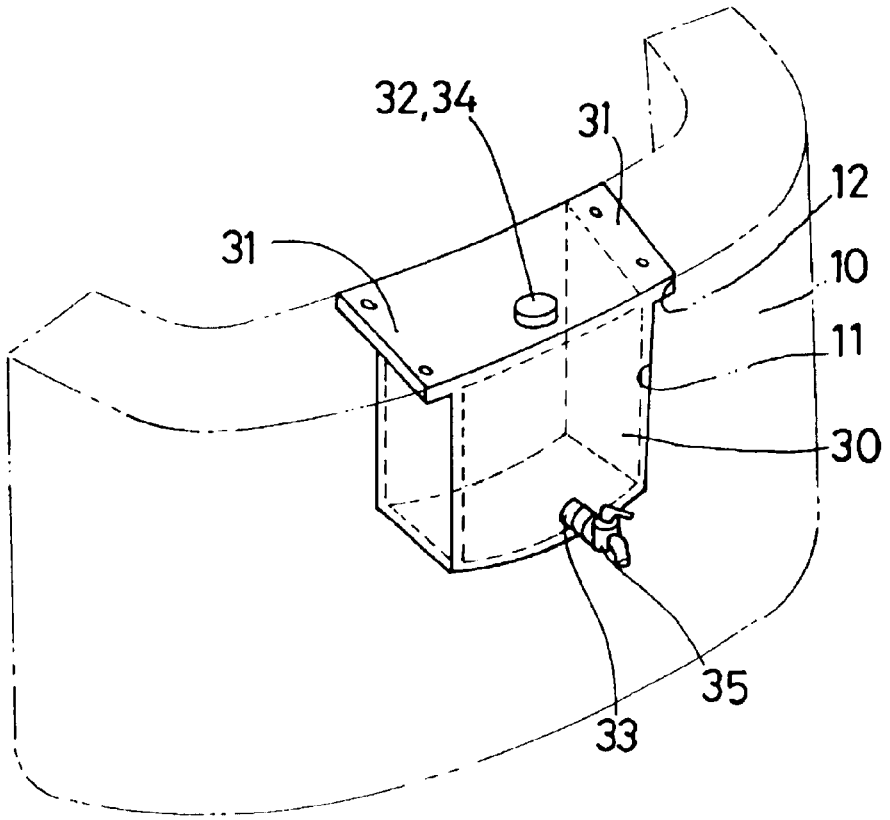
FIG. 4 is a perspective view of a separable sub-counterweight serving as a water tank.

FIG. 4 shows an example in which the separable sub-counterweight of the first embodiment is applied as a water tank. Specifically, a separable sub-counterweight 30 located in the center is formed as a water tank 30 having a contour which fits in the opening 11. The water tank 30 has mounting flanges 31 which are respectively fitted in and bolted to the stepped portions 12 formed on the upper edge of the opening 11 of the counterweight 10. In the water tank 30, a water pouring spout 32 is formed on the top and a drain 33 is attached to the lower part so as to face outward. A cap 34 is detachably attached to the water pouring spout 32 and a cock 35 is attached to the drain 33.

Figure 5:
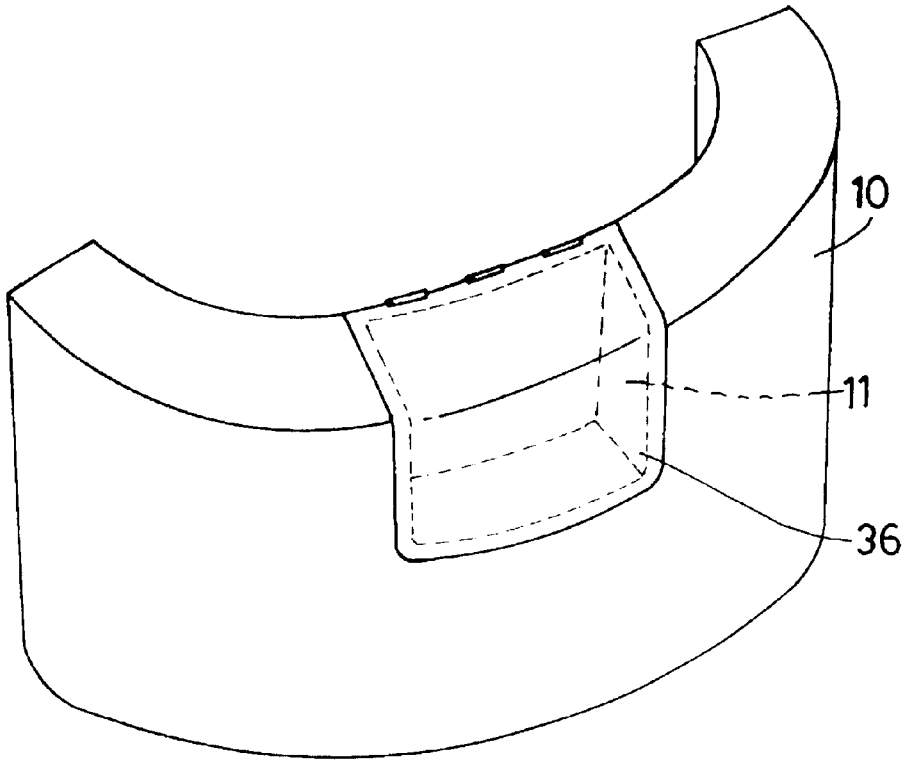
FIG. 5 is a perspective view of a counterweight with a cover attached to an opening section.

In normal operation, the water tank 30 thus arranged is fixedly attached to the opening 11 similarly to the above-described separable sub-counterweight 13, while being filled with water which has been introduced through the water pouring spout 32 formed on the top. In this arrangement, the water filled in the water tank 30 serves as a weight. In other words, the water tank 30 assumes the role of a separable sub-counterweight. When a check or repairs are required, the cock 35 attached to the drain 33 is opened to discharge the water stored inside the water tank 30 so that the water tank 30 is emptied, becoming lightweight. This makes it possible to detach the water tank 30 from the opening 11 by persons. Accordingly, a check and repairs of the engine part can be easily carried out by detaching the water tank 30 in a job site where a crane or similar hoisting machine is not available. Wherever a supply of water is available, the water tank 30 can be assembled to serve as a weight only by pouring water into it.

Where the reactive force relative to the operation of the implement can be made up for without making a change in the opening 11 of the counterweight 10, a cover 36 is attached as shown in FIG. 5 to cover the opening 11 from its top face to its outer face and this cover 36 is opened upward during checking thereby exposing the opening 11 outward so that worker can work on the parts in the engine chamber from outside. In this case, it is preferable to fasten the cover 36 by a latch or bolt (not shown) when the opening 11 is brought into its closed condition. Similarly, the right and left openings 16, 17 may be provided with a cover which is opened only during work so that work such as inside checking can be carried out from outside.

Figure 6:
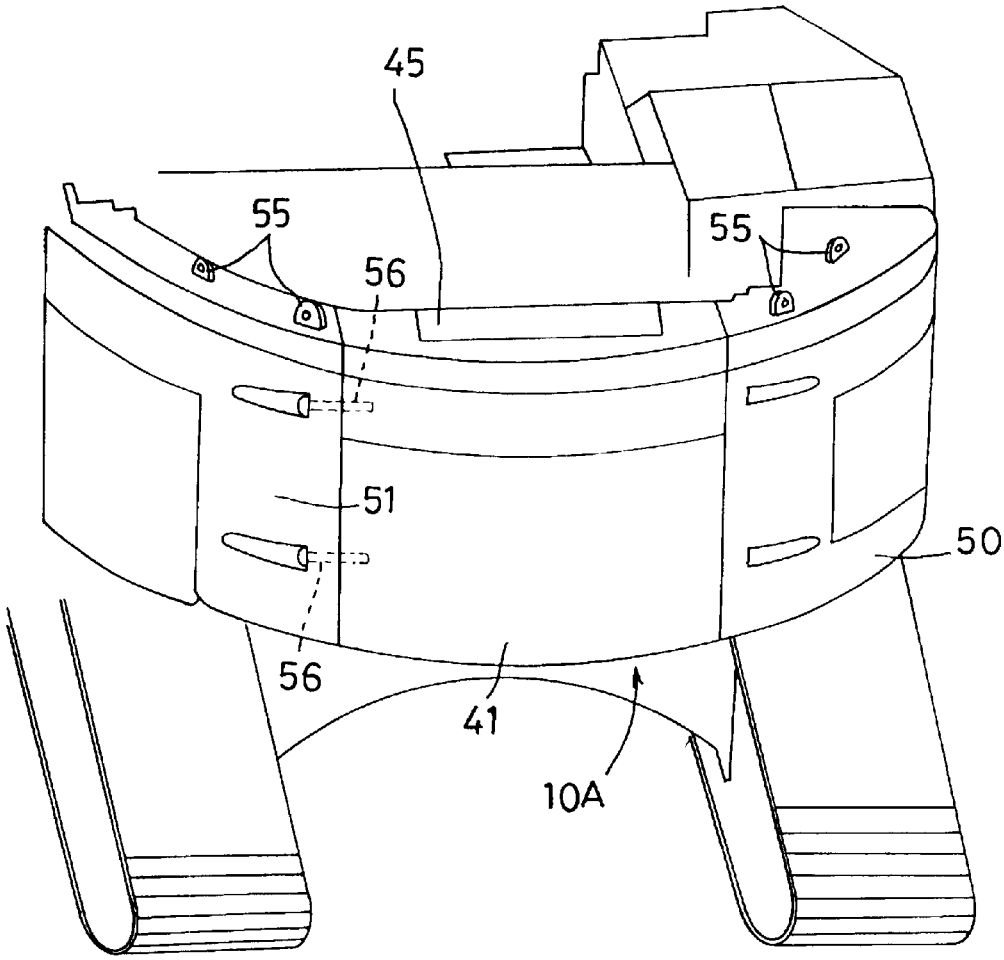
FIG. 6 is a perspective view of a counterweight for a construction vehicle according to a second embodiment of the invention.
Figure 7:
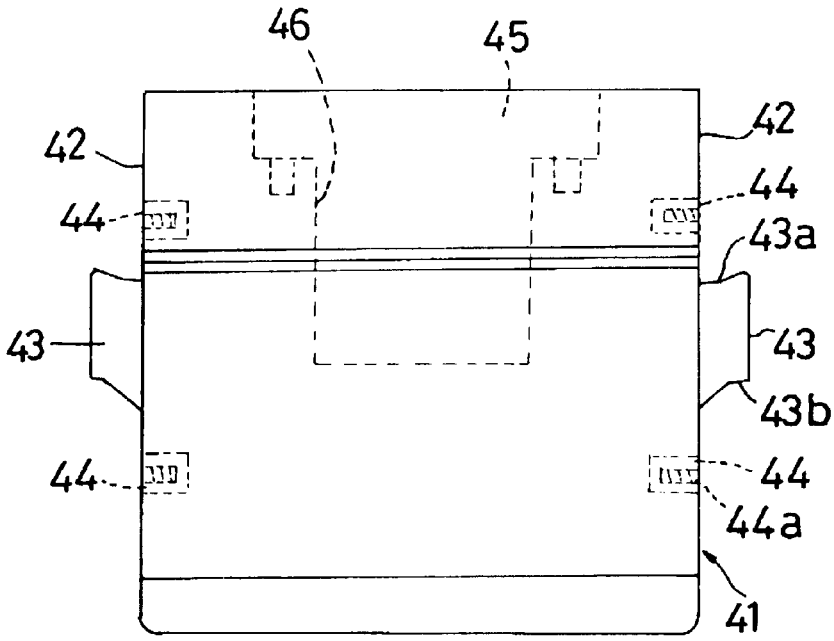
FIG. 7(*a*) is a front view of a central region of the divided counterweight according to the second embodiment and FIG. 7(*b*) is a perspective view of the same when viewed from the rear face.
Figure 7:
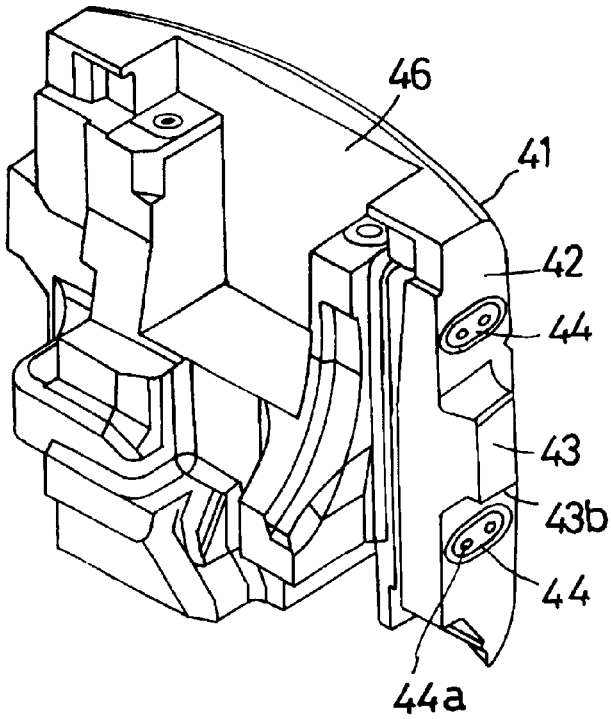
Figure 8:
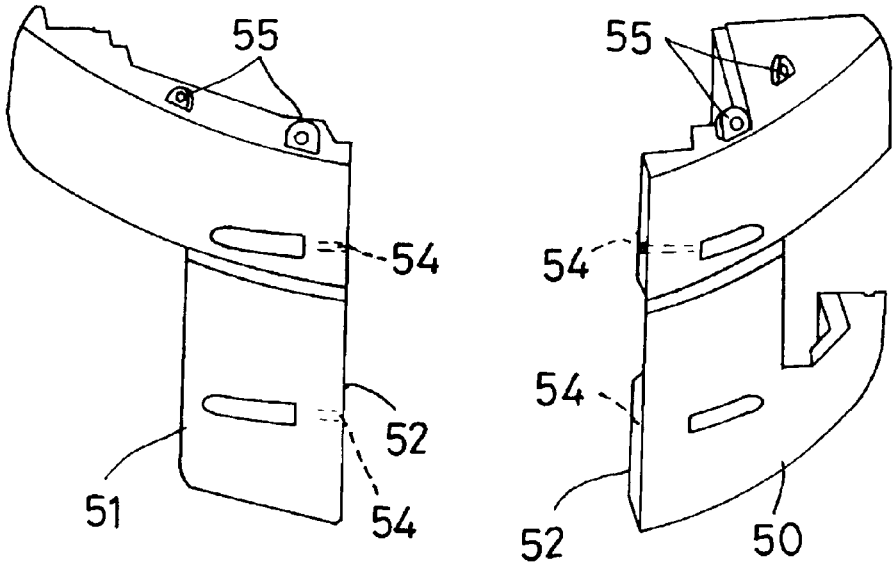
FIG. 8 is a perspective view of right and left separable sub-counterweights according to the second embodiment.
Figure 9:
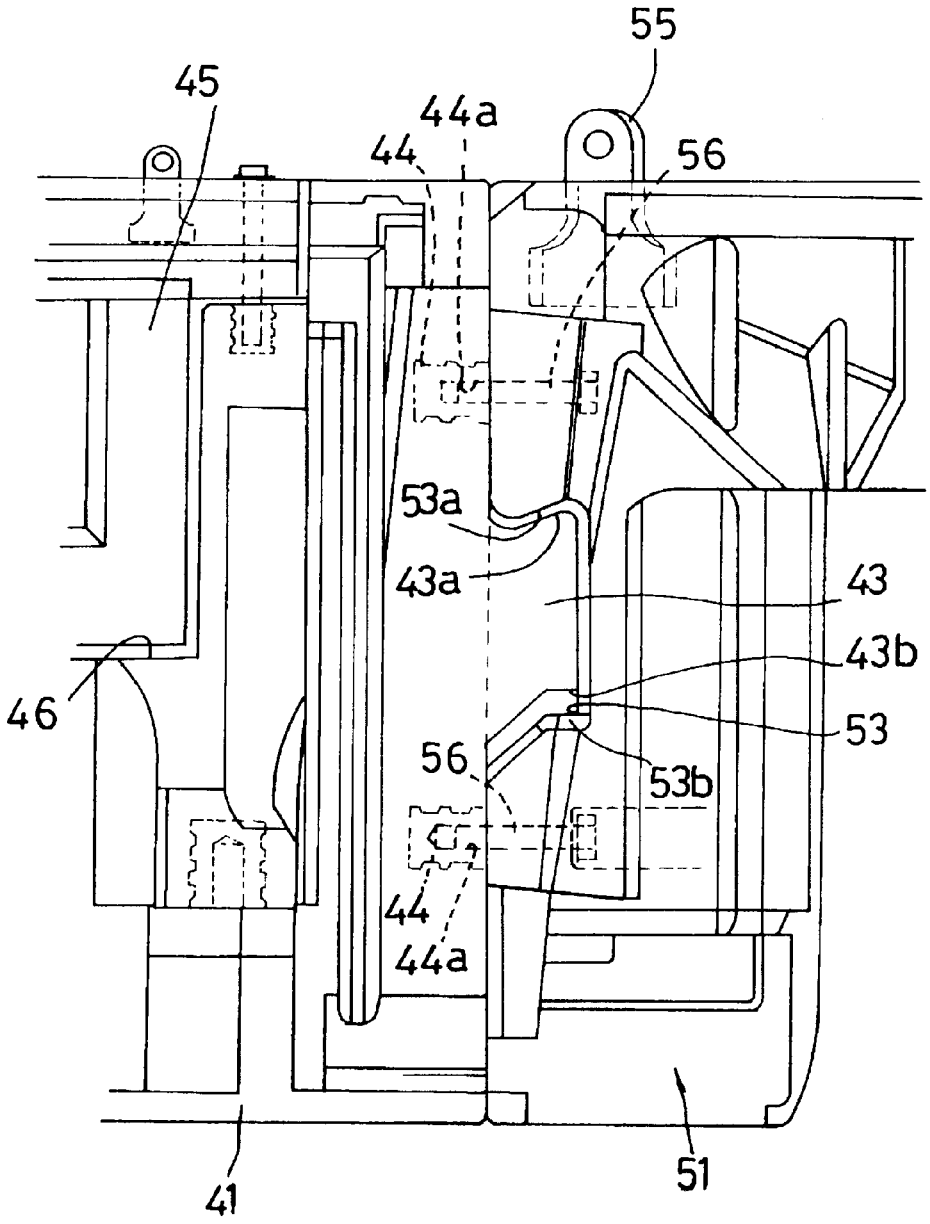
FIG. 9 is an enlarged detailed view of a connecting section in each separable sub-counterweight of the second embodiment.
Figure 10:
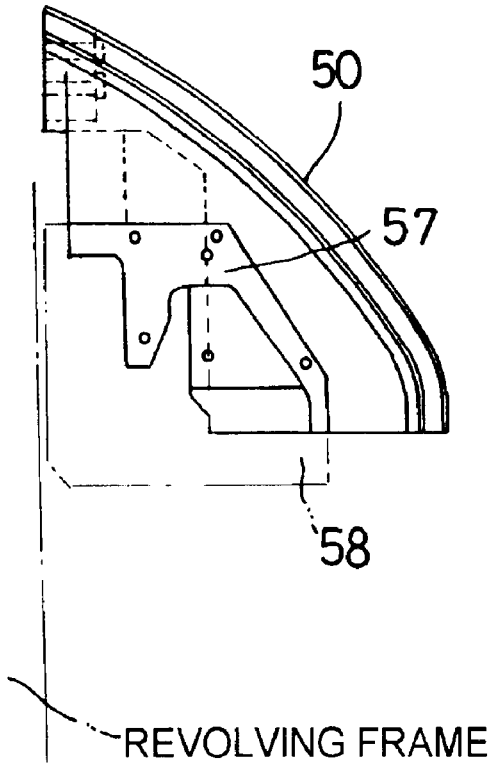
FIG. 10 is a bottom plan view of the right separable sub-counterweight of the second embodiment.

FIG. 6 shows a perspective view of a counterweight for a construction vehicle according to a second embodiment of the invention. FIG. 7(*a*) is a front view showing the central region of the divided counterweight and FIG. 7(*b*) is a perspective view of the same when viewed from its rear face. FIG. 8 is a perspective view of right and left separable sub-counterweights. FIG. 9 is an enlarged detailed view of a connecting section in each separable sub-counterweight. FIG. 10 is a bottom plan view of the right separable sub-counterweight.

A counterweight 10A constructed according to the second embodiment shown in these figures is divided into substantially three parts which are a central region and right and left side regions. Among these regions, the central sub-counterweight 41 is fixedly bolted to the revolving superstructure (not shown) at the bottom face thereof. The right and left separable sub-counterweights 50, 51 respectively have a fitting structure relative to the central sub-counterweight 41 and bolted to the central sub-counterweight 41 at their parting sections, while the central sub-counterweight 41 working as a base.

As shown in FIG. 7(*a*), the central sub-counterweight 41 is provided with projections 43 which are laterally oriented, being positioned substantially at the vertically middle points of its right and left parting faces 42. These projections 43 are symmetrically formed such that the distal end of each projection 43 is moderately sloped toward the rear face and its upper face 43*a* has an outwardly rising slope while the tip of the lower face serving as a stopper 43*b*. Upper and lower fastening pieces 44 each having threaded holes 44*a* are embedded in each of the parting faces 42, these threaded holes 44*a* being used in bolting the right and left separable sub-counterweights 50, 51. This sub-counterweight 41 is made from cast iron and has the aforesaid fastening pieces 44 embedded therein to attain stabilization in strength. The sub-counterweight 41 also has a recess on the rear face side thereof in order that it should be prevented from touching the engine housed in the engine chamber.

The central sub-counterweight 41 further has a detachable auxiliary sub-counterweight 45 fitted to the inner side of the central upper half thereof. The auxiliary sub-counterweight 45 is detachable in an upward direction and a recess 46 left after the detachment of the auxiliary sub-counterweight 45 is utilized as a space to facilitate operations such as detachment/attachment of an injection pump for the engine.

The right and left separable sub-counterweights 50, 51 are partially cut away as shown in FIG. 8 so that the parts mounted on the revolving superstructure at the time of assembly can be normally operated from outside. The outer faces of the separable sub-counterweights 50, 51 are flush with the outer face of the center sub-counterweight 41, forming a curved face elegant in design. Similarly to the central sub-counterweight 41, the separable sub-counterweights 50, 51 are provided with a recess at a position corresponding to the position of the parts (e.g., main pump and radiator) mounted on the revolving superstructure in order to avoid the contact between these sub-counterweights 50, 51 and the parts.

Each of the right and left separable sub-counterweights 50, 51 thus formed has an engagement recess 53 at the center of its parting joint face 52 adjoining the central sub-counterweight 41. These engagement recesses 53 open on the rear face side. These recesses 53 have substantially the same shape as that of the projections 43 but are larger than the projections 43 by the size of the gaps which are formed in an appropriately determined size. The projections 43 and the engagement recesses 53 constitute a fitting section (engagement section) for the central sub-counterweight 41 and the separable sub-counterweights 50, 51. At the positions on the parting joint faces 52 which correspond to the locations of the fastening pieces 44 of the central sub-counterweight 41, bolt holes 54 are formed, piercing the parting joint faces 52 at right angles from the outer faces. As shown in FIG. 9, the aforesaid engagement recesses 53 are preferably formed such that their inner upper faces 53*a* are in contact with the upper faces 43*a* of the projections 43 of the central sub-counterweight 41 when the engagement recesses 53 are connected to the central sub-counterweight 41. This facilitates fastening with bolts. Reference numeral 55 designates a suspension lug used for slinging work at the time of attachment/detachment of the sub-counterweights.

In the counterweight 10A of the second embodiment thus formed, the central sub-counterweight 41 is fixedly bolted to the revolving superstructure of the vehicle and the separable sub-counterweights 50, 51 are integrally fastened to the right and left sides of the central sub-counterweight 41 from their respective outer faces by means of bolts 56, while the central sub-counterweight 41 working as a base, whereby the counterweight 10A functions similarly to an ordinary counterweight.

When making a check and doing maintenance (repairs) on the engine chamber, radiator or main pump (the radiator and main pump are placed on the right and left sides of the engine chamber), either the right separable sub-counterweight 50 or left separable sub-counterweight 51, which corresponds to the location of a part requiring a check and maintenance, is detached, thereby making the front face of the objective part exposed. Accordingly, the worker can carry out a desired operation, standing on the ground in a natural pose.

When the bolts 56 screwed into the threaded holes 44*a* of the fastening pieces 44 of the central sub-counterweight 41 are removed in order to detach the separable sub-counterweight 50 or 51 being in a slung condition, the detaching operation is carried out with the separable sub-counterweight 50 or 51 being suspended by a crane or the like so that the separable sub-counterweight 50 or 51 (hereinafter represented by the separable sub-counterweight 50) suspended by a lifting sling tends to be pulled up. Therefore, at the instant the bolts 56 have been removed, the separable sub-counterweight 50 is shifted upward. At the parting section, the inner lower face 53*b* of the engagement recess 53 of the separable sub-counterweight 50 to be separated and lifted comes in contact with the stopper 43*b* of the projection 43 formed on the central sub-counterweight 41 which is fixedly placed and has a fitting structure, so that excessive lifting of the separable sub-counterweight 50 is prevented (see FIG. 9). In this way, a collision between the sub-counterweight and the installed parts can be avoided.

After unbolting, the separable sub-counterweight 50 is just moved sideways, being removed from the fitting section and then placed on the ground for carrying out the desired operation. Since the engagement recess 53 of the separable sub-counterweight 50 is larger in size than the projection 43 as mentioned earlier, no problem arises during the movement of the separable sub-counterweight 50.

For putting the detached separable sub-counterweight 50 back after the work is finished, slinging work is again carried out and then the sub-counterweight 50 is lifted and carried, by a crane or the like, to the side of the central sub-counterweight 41 for connecting them. When coupling these sub-counterweights 41, 50 at the connecting section, the engagement recess 53 of the separable sub-counterweight 50 being lifted is fitted on the projection 43 of the central sub-counterweight 41. At that time, the separable sub-counterweight 50 is lifted such that the inner upper face 53*a* of the engagement recess 53 is placed on the upper face 43*a* of the projection 43. In this condition, the bolt hole 54 just fits to the threaded hole 44*a* of the central sub-counterweight 41, so that the separable sub-counterweight 50 can be fastened as it is by the bolts 56. Thus, the connection work can be readily carried without the troublesome operation of adjusting the suspension height of the sub-counterweight 50 for positioning of the bolt hole 54. In addition, since the inner upper face 53*a* of the engagement recess 53 can be temporarily placed on the upper face 43*a* of the projection 43 as described above, there is no need to worry about falling-down of the separable sub-counterweight 50 by mistake so that the operation can be carried out with safety.

According to the second embodiment, even when maintenance (checking) is given to a construction vehicle having a small-turn type implement with insufficient installation space, maintenance work can be carried out without any difficulty by detaching the sub-counterweight located in the position corresponding to the position of an objective part for maintenance. In addition, the worker can carry out the work standing on the ground in a natural pose, so that improved working efficiency can be achieved. It should be noted that when doing maintenance on the engine section such as attachment/detachment of the injection pump for the engine, the maintenance work can be carried out utilizing the space created by detaching the auxiliary sub-counterweight 45 from the central sub-counterweight 41.

The above-described counterweight of the second embodiment may be arranged such that a mounting 57 is formed on the bottom face of the right separable sub-counterweight 50 and a lower face plate 58 for covering the peripheral devices of the pumps is attached to the mounting 57 as shown in FIG. 10. In this arrangement, a lower face plate which is conventionally supported by a revolving frame can be attached to the right separable sub-counterweight 50, so that it can be easily handled when carrying out maintenance work on the lower section. As a result, the need for providing the revolving frame with a mounting section for the cover (i.e., lower face plate) can be eliminated, so that material used in formation of the mounting section can be saved, the weight of the revolving frame can be reduced, and the cost incurred by machining of the material can be reduced, resulting in improved economy.

In the present embodiment, the auxiliary sub-counterweight 45, the central sub-counterweight 41 (the portion excluding the auxiliary sub-counterweight 45) and the right and left separable sub-counterweights 50, 51 have substantially the same weight. By virtue of this, the same equipment (e.g., 2.9 ton crane) can be used for detaching these sub-counterweights, so that the operation can be facilitated.

In the present embodiment, the engagement section for engaging the central sub-counterweight 41 with the separable sub-counterweights 50, 51 is composed of the projections 43 formed on the central sub-counterweight 41 and the engagement recesses 53 defined in the separable sub-counterweights 50, 51, but other arrangements may be employed. For instance, the positions of the concavities and the convexities may be exchanged. Specifically, projections (convexities) formed on the separable sub-counterweights 50, 51 may be engaged with engagement recesses (concavities) formed on the central sub-counterweight 41. Another alternative is such that first engagement pieces of substantially L shape which have a different leveled portion are formed on either the sub-counterweight 41 or the sub-counterweights 50, 51, while second engagement pieces of substantially inverted L shape are formed on the other so as to be fitted in the first engagement pieces, thereby establishing engagement between the first and second engagement pieces.

Although the separable sub-counterweights 50, 51 are formed on the right and left sides of the central sub-counterweight 41 in the present embodiment, both sides of the central sub-counterweight 41 are not necessarily provided with a separable sub-counterweight. An embodiment having one separable sub-counterweight placed on either side is possible.

What is claimed is:

1. A counterweight in combination with a construction vehicle having a traveling vehicle body and a revolving superstructure with an implement, and the counterweight placed in the rear of the revolving superstructure, the counterweight comprising a region of the counterweight corresponding to the position of a part on said construction vehicle requiring repairs being detachably formed, and at least one opening transversely penetrating completely through the counterweight, wherein the opening transversely penetrating completely through the counterweight is located at the center of a top portion of the counterweight and a central separable sub-counterweight having a shape of the opening is adapted to be detachably mounted in the opening from above.

2. A counterweight in combination with a construction vehicle having a traveling vehicle body and a revolving superstructure with an implement, and the counterweight placed in the rear of the revolving superstructure, the counterweight comprising a region of the counterweight corresponding to the position of a part on said construction vehicle requiring repairs being detachably formed, and at least one opening transversely penetrating completely through the counterweight, wherein openings transversely penetrating completely through the counterweight are located at the right and left comers of a top portion of the counterweight and a separable left and right sub-counterweight is adapted to be detachably mounted on the opening defined at the left and right corners respectively.

3. A counterweight in combination with a construction vehicle having a traveling vehicle body and a revolving superstructure with an implement, and the counterweight placed in the rear of the revolving superstructure, the counterweight comprising a region of the counterweight corresponding to the position of a part on said construction vehicle requiring repairs being detachably formed, a central sub-counterweight disposed at the center of the counterweight, an auxiliary sub-counterweight detachably attached to the inner side of the upper half of the central sub-counterweight disposed at the center of the counterweight, and a separable sub-counterweight detachably mounted on either or both of the right and left sides of the central sub-counterweight, wherein:

parting faces of the central sub-counterweight and either or both of the left and right separable sub-counterweights are provided with a fitting section, and each fitting section serves to support the separable sub-counterweight for preventing vertical downward movement at the time of attachment.

4. The counterweight in combination with a construction vehicle according to claim 3, wherein each fitting section formed on the central sub-counterweight and left and right separable sub-counterweights has a horizontally oriented gap, and the fitting section serves as a stopper for preventing vertical movement of the left and right separable sub-counterweights at the time of detachment.

5. A counterweight in combination with a construction vehicle having a traveling vehicle body and a revolving superstructure with an implement, and the counterweight placed in the rear of the revolving superstructure, the counterweight comprising a region of the counterweight corresponding to the position of a part on said construction vehicle requiring repairs being detachably formed, at least one opening transversely penetrating completely through the counterweight, a central sub-counterweight disposed at the center of the counterweight, and an auxiliary sub-counterweight detachably attached to the inner side of the upper half of the central sub-counterweight disposed at the center of the counterweight and, a separable sub-counterweight detachably mounted on either or both of the right and left sides of the counterweight, parting faces of the central sub-counterweight and left and right separable sub-counterweights being provided with a fitting section, wherein each fitting section formed on the central sub-counterweight and left and right separable sub-counterweights has a horizontally oriented gap, and the fitting section serves as a stopper for preventing vertical movement of the left and right separable sub-counterweights at the time of detachment, wherein each fitting section has a projection formed on a parting face of one sub-counterweight which works as a base, and an engagement recess formed in a parting face of the other sub-counterweight which fits to the parting face of said one sub-counterweight, said projection and said recess having the horizontally oriented gap, said engagement recess being adapted to be fitted on said projection, and wherein said parting faces are fastened by fasteners from outside.

6. The counterweight in combination with a construction vehicle according to claim 5, wherein the central sub-counterweight and the left and right separable sub-counterweights have, at their lower portions, a common lower face plate for covering lower parts of the construction vehicle requiring maintenance.

* * * * *